US010256537B2

(12) United States Patent
Besoli et al.

(10) Patent No.: US 10,256,537 B2
(45) Date of Patent: Apr. 9, 2019

(54) LENS-ENHANCED PHASED ARRAY ANTENNA PANEL

(71) Applicant: Movandi Corporation, Newport Beach, CA (US)

(72) Inventors: Alfred Grau Besoli, Irvine, CA (US); Seunghwan Yoon, Irvine, CA (US); Ahmadreza Rofougaran, Newport Coast, CA (US); Farid Shirinfar, Granada Hills, CA (US); Sam Gharavi, Irvine, CA (US); Michael Boers, South Turramurra (AU); Maryam Rofougaran, Rancho Palos Verdes, CA (US)

(73) Assignee: Movandi Corporation, Newport Beach, CA (US)

( * ) Notice: Subject to any disclaimer, the term of this patent is extended or adjusted under 35 U.S.C. 154(b) by 2 days.

(21) Appl. No.: 15/335,034

(22) Filed: Oct. 26, 2016

(65) Prior Publication Data

US 2018/0115083 A1 Apr. 26, 2018

(51) Int. Cl.

| | |
|---|---|
| ***H01Q 15/02*** | (2006.01) |
| ***H01Q 19/06*** | (2006.01) |
| ***H01Q 3/26*** | (2006.01) |
| ***H01Q 21/00*** | (2006.01) |
| ***H01Q 21/06*** | (2006.01) |

(52) U.S. Cl.

CPC ..... *H01Q 3/2658* (2013.01); *H01Q 19/062* (2013.01); *H01Q 21/0025* (2013.01); *H01Q 21/065* (2013.01)

(58) Field of Classification Search

CPC ..... H01Q 15/08; H01Q 15/02; H01Q 19/06; H01Q 19/062; H01Q 1/36; H01Q 1/38; H01Q 3/2658

See application file for complete search history.

(56) References Cited

U.S. PATENT DOCUMENTS

| | | | | |
|---|---|---|---|---|
| 2,579,324 A * | 12/1951 | Kock | ..... | H01Q 15/02 333/248 |
| 4,380,013 A * | 4/1983 | Slysh | ..... | F24J 2/1052 136/245 |
| 6,911,956 B2 * | 6/2005 | Miyata | ..... | H01Q 13/22 343/771 |

(Continued)

OTHER PUBLICATIONS

Imbert, Marc, et al. "Design and Performance Evaluation of a Dielectric Flat Lens Antenna for Millimeter-Wave Applications," *IEEE Antennas and Wireless Propagation Letters*, vol. 14, 2015. pp. 1-4.

(Continued)

*Primary Examiner* — Tho G Phan

(74) *Attorney, Agent, or Firm* — Farjami & Farjami LLP

(57) ABSTRACT

A lens-enhanced phased array antenna panel includes a phased array antenna panel and at least one lens situated over the phased array antenna panel. The phased array antenna panel has a plurality of antennas arranged in a plurality of antenna segments. Each lens corresponds to at least one of the antenna segments. Each lens is configured to increase a gain of its corresponding antenna segment. Each lens increases a total gain of the phased array antenna panel. Additionally, each lens can provide an angular offset to direct a radio frequency (RF) beam onto its corresponding antenna segment.

20 Claims, 11 Drawing Sheets

(56) References Cited

U.S. PATENT DOCUMENTS

| | | | | |
|---|---|---|---|---|
| 7,170,442 | B2 * | 1/2007 | Lovberg | G01V 8/005 250/332 |
| 8,274,443 | B2 * | 9/2012 | Hauhe | H01Q 1/085 343/793 |
| 2002/0165001 | A1 * | 11/2002 | Phillips | G01V 8/005 455/500 |
| 2008/0100504 | A1 * | 5/2008 | Martin | H01Q 3/22 342/179 |
| 2011/0025432 | A1 * | 2/2011 | Gagnon | H01Q 15/0006 333/156 |

OTHER PUBLICATIONS

Abbaspour-Tamijani, Abbas, et al. "Enhancing the Directivity of Phased Array Antennas Using Lens-Arrays," *Progress In Electromagnetics Research M*, vol. 29, 2013. pp. 41-64.

M. Imbert, A. Papio, F. De Flaviis, L. Jofre, and J. Romeu, "Design and performance evaluation of a dielectric flat lens antenna for millimeter-wave applications," Antennas and Wireless Propagation Letters, IEEE, vol. 14, pp. 342-345, 2015.

* cited by examiner

LENS-ENHANCED PHASED ARRAY ANTENNA PANEL

RELATED APPLICATION(S)

The present application is related to U.S. patent application Ser. No. 15/225,071, filed on Aug. 1, 2016, and titled "Wireless Receiver with Axial Ratio and Cross-Polarization Calibration," and U.S. patent application Ser. No. 15/225,523, filed on Aug. 1, 2016, and titled "Wireless Receiver with Tracking Using Location, Heading, and Motion Sensors and Adaptive Power Detection," and U.S. patent application Ser. No. 15/226,785, filed on Aug. 2, 2016, and titled "Large Scale Integration and Control of Antennas with Master Chip and Front End Chips on a Single Antenna Panel," and U.S. patent application Ser. No. 15/255,656, filed on Sep. 2, 2016, and titled "Novel Antenna Arrangements and Routing Configurations in Large Scale Integration of Antennas with Front End Chips in a Wireless Receiver," and U.S. patent application Ser. No. 15/256,038 filed on Sep. 2, 2016, and titled "Transceiver Using Novel Phased Array Antenna Panel for Concurrently Transmitting and Receiving Wireless Signals," and U.S. patent application Ser. No. 15/256,222 filed on Sep. 2, 2016, and titled "Wireless Transceiver Having Receive Antennas and Transmit Antennas with Orthogonal Polarizations in a Phased Array Antenna Panel," and U.S. patent application Ser. No. 15/278,970 filed on Sep. 28, 2016, and titled "Low-Cost and Low-Loss Phased Array Antenna Panel," and U.S. patent application Ser. No. 15/279,171 filed on Sep. 28, 2016, and titled "Phased Array Antenna Panel Having Cavities with RF Shields for Antenna Probes," and U.S. patent application Ser. No. 15/279,219 filed on Sep. 28, 2016, and titled "Phased Array Antenna Panel Having Quad Split Cavities Dedicated to Vertical-Polarization and Horizontal-Polarization Antenna Probes." The disclosures of all of these related applications are hereby incorporated fully by reference into the present application.

BACKGROUND

Phased array antenna panels with large numbers of antennas and front end chips integrated on a single board are being developed in view of higher wireless communication frequencies being used between a satellite transmitter and a wireless receiver, and also more recently in view of higher frequencies used in the evolving 5G wireless communications (5th generation mobile networks or 5th generation wireless systems). Phased array antenna panels are capable of beamforming by phase shifting and amplitude control techniques, and without physically changing direction or orientation of the phased array antenna panels, and without a need for mechanical parts to effect such changes in direction or orientation.

Receiving adequate power is critical in establishing reliable wireless communications. Power received by a phased array antenna panel can be increased by proper beamforming and also by increasing the area of the array and the number of antennas residing in the array. However, due to space limitations, this approach can be impractical. Thus, there is a need in the art to increase power received by a wireless receiver employing a phased array antenna panel without increasing the size of the phased array antennal panel.

SUMMARY

The present disclosure is directed to lens-enhanced phased array antenna panels, substantially as shown in and/or described in connection with at least one of the figures, and as set forth in the claims.

DETAILED DESCRIPTION

Figure 1A:
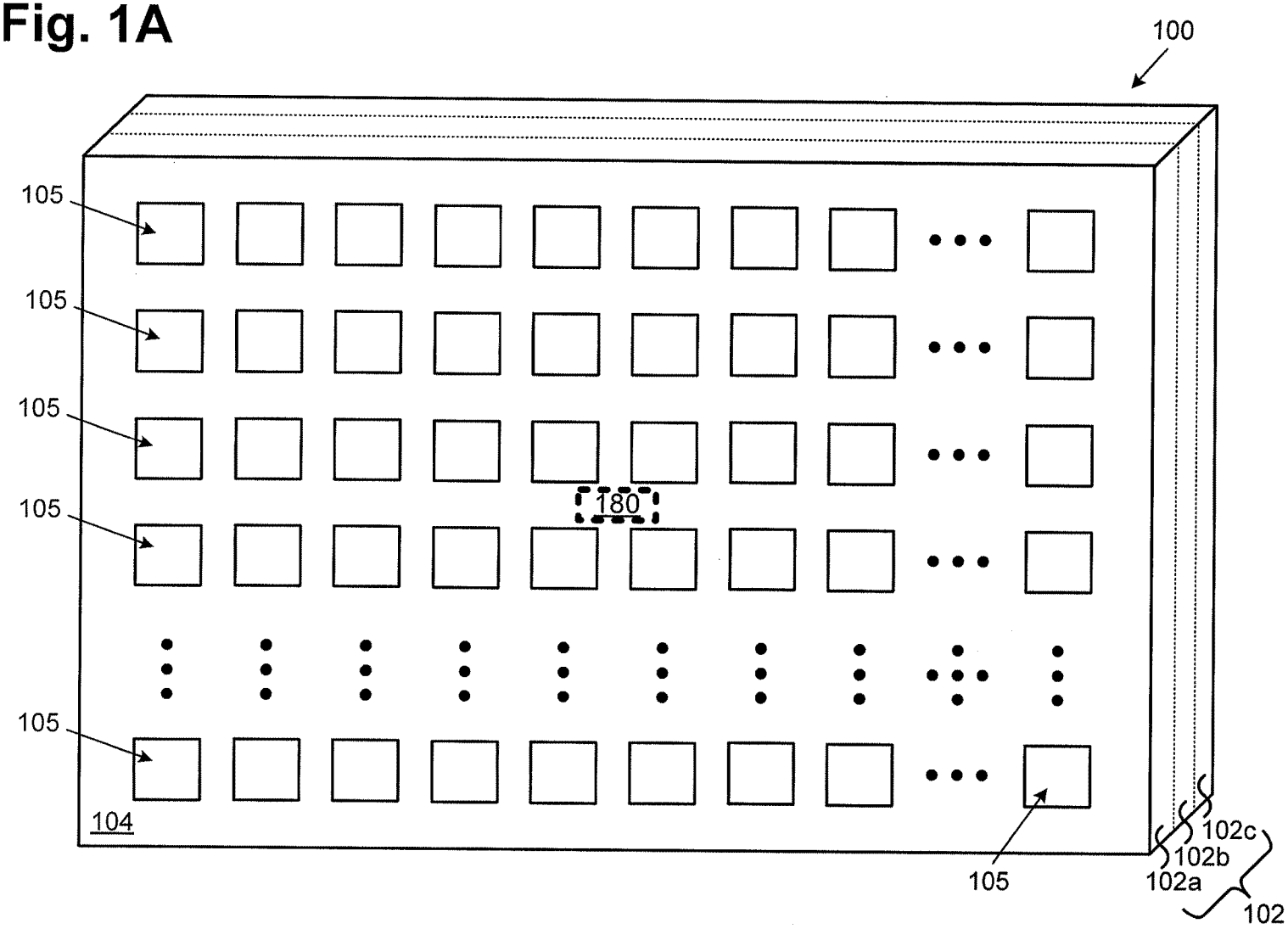
FIG. 1A illustrates a perspective view of a portion of an exemplary phased array antenna panel according to one implementation of the present application.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

FIG. 1A illustrates a perspective view of a portion of an exemplary phased array antenna panel according to one implementation of the present application. As illustrated in FIG. 1A, phased array antenna panel 100 includes substrate 102 having layers 102*a*, 102*b*, and 102*c*, front surface 104 having front end units 105, and master chip 180. In the present implementation, substrate 102 may be a multi-layer printed circuit board (PCB) having layers 102*a*, 102*b*, and 102*c*. Although only three layers are shown in FIG. 1A, in another implementation, substrate 102 may be a multi-layer PCB having greater or fewer than three layers.

As illustrated in FIG. 1A, front surface 104 having front end units 105 is formed on top layer 102*a* of substrate 102. In one implementation, substrate 102 of phased array antenna panel 100 may include 500 front end units 105, each having a radio frequency (RF) front end circuit connected to a plurality of antennas (not explicitly shown in FIG. 1A). In one implementation, phased array antenna panel 100 may include 2000 antennas on front surface 104, where each front end unit 105 includes four antennas connected to an RF front end circuit (not explicitly shown in FIG. 1A).

In the present implementation, master chip 180 may be formed in layer 102*c* of substrate 102, where master chip 180 may be connected to front end units 105 on top layer 102*a* using a plurality of control buses (not explicitly shown in FIG. 1A) routed through various layers of substrate 102. In the present implementation, master chip 180 is configured to provide phase shift and amplitude control signals from a digital core in master chip 180 to the RF front end chips in each of front end units 105 based on signals received from the antennas in each of front end units 105.

Figure 1B:
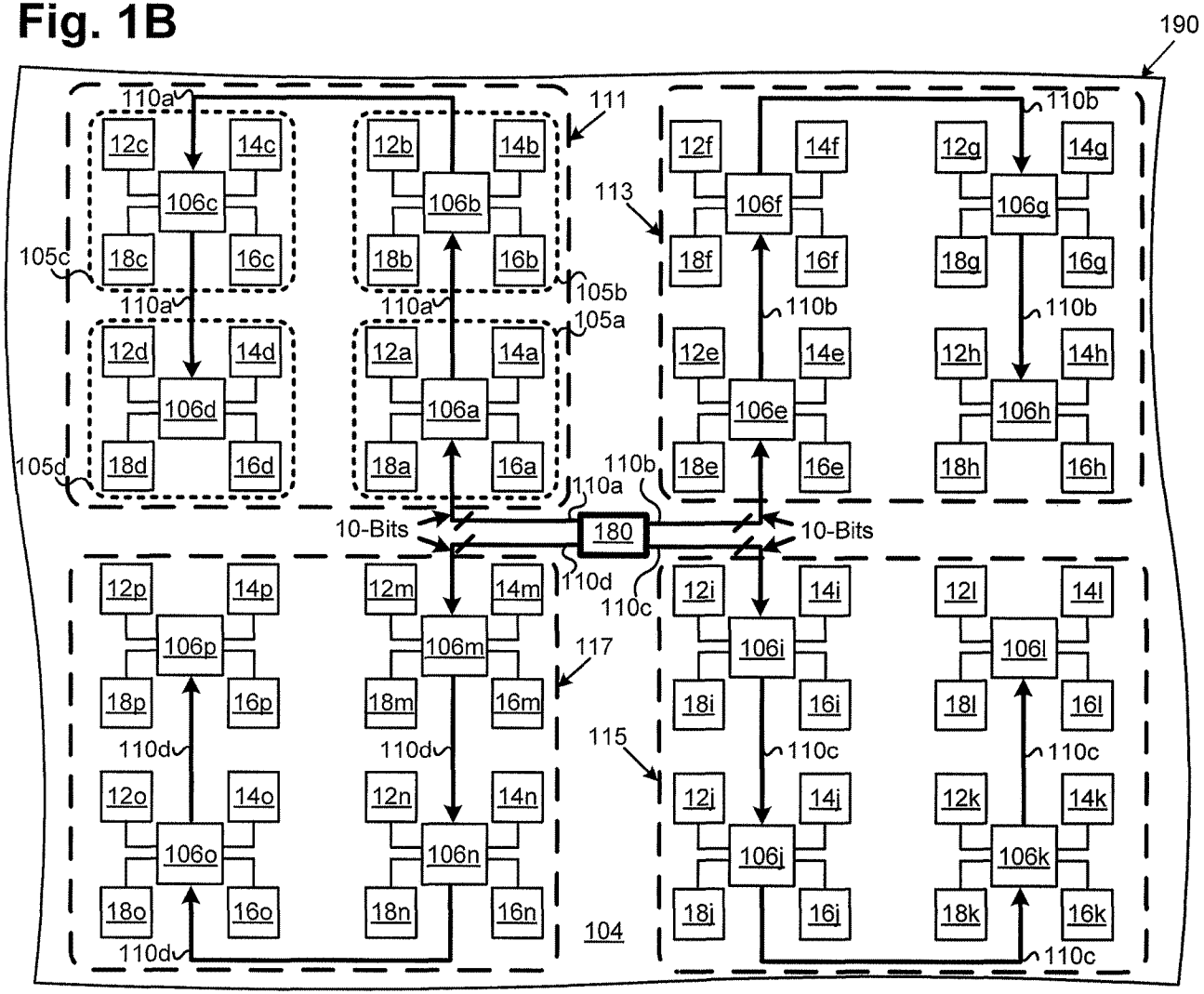
FIG. 1B illustrates a layout diagram of a portion of an exemplary phased array antenna panel according to one implementation of the present application.

FIG. 1B illustrates a layout diagram of a portion of an exemplary phased array antenna panel according to one implementation of the present application. For example, layout diagram 190 illustrates a layout of a simplified phased array antenna panel on a single printed circuit board (PCB), where master chip 180 is configured to drive in parallel four control buses, e.g., control buses 110*a*, 110*b*, 110*c*, and 110*d*, where each control bus is coupled to a respective antenna segment, e.g., antenna segments 111, 113, 115, and 117, where each antenna segment has four front end units, e.g., front end units 105*a*, 105*b*, 105*c*, and 105*d* in antenna segment 111, where each front end unit includes an RF front end chip, e.g., RF front end chip 106*a* in front end unit 105*a*, and where each RF front end chip is coupled to four antennas, e.g., antennas 12*a*, 14*a*, 16*a*, and 18*a* coupled to RF front end chip 106*a* in front end unit 105*a*.

As illustrated in FIG. 1B, front surface 104 includes antennas 12*a* through 12*p*, 14*a* through 14*p*, 16*a* through 16*p*, and 18*a* through 18*p*, collectively referred to as antennas 12-18. In one implementation, antennas 12-18 may be configured to receive and/or transmit signals from and/or to one or more commercial geostationary communication satellites or low earth orbit satellites.

In one implementation, for a wireless transmitter transmitting signals at 10 GHz (i.e., $\lambda$=30 mm), each antenna needs an area of at least a quarter wavelength (i.e., $\lambda/4$=7.5 mm) by a quarter wavelength (i.e., $\lambda/4$=7.5 mm) to receive the transmitted signals. As illustrated in FIG. 1B, antennas 12-18 in front surface 104 may each have a square shape having dimensions of 7.5 mm by 7.5 mm, for example. In one implementation, each adjacent pair of antennas 12-18 may be separated by a distance of a multiple integer of the quarter wavelength (i.e., $n*\lambda/4$), such as 7.5 mm, 15 mm, 22.5 mm and etc. In general, the performance of the phased array antenna panel improves with the number of antennas 12-18 on front surface 104.

In the present implementation, the phased array antenna panel is a flat panel array employing antennas 12-18, where antennas 12-18 are coupled to associated active circuits to form a beam for reception (or transmission). In one implementation, the beam is formed fully electronically by means of phase control devices associated with antennas 12-18. Thus, phased array antenna panel 100 can provide fully electronic beamforming without the use of mechanical parts.

As illustrated in FIG. 1B, RF front end chips 106*a* through 106*p*, and antennas 12*a* through 12*p*, 14*a* through 14*p*, 16*a* through 16*p*, and 18*a* through 18*p*, are divided into respective antenna segments 111, 113, 115, and 117. As further illustrated in FIG. 1B, antenna segment 111 includes front end unit 105*a* having RF front end chip 106*a* coupled to antennas 12*a*, 14*a*, 16*a*, and 18*a*, front end unit 105*b* having RF front end chip 106*b* coupled to antennas 12*b*, 14*b*, 16*b*, and 18*b*, front end unit 105*c* having RF front end chip 106*c* coupled to antennas 12*c*, 14*c*, 16*c*, and 18*c*, and front end unit 105*d* having RF front end chip 106*d* coupled to antennas 12*d*, 14*d*, 16*d*, and 18*d*. Antenna segment 113 includes similar front end units having RF front end chip 106*e* coupled to antennas 12*e*, 14*e*, 16*e*, and 18*e*, RF front end chip 106*f* coupled to antennas 12*f*, 14*f*, 16*f*, and 18*f*, RF front end chip 106*g* coupled to antennas 12*g*, 14*g*, 16*g*, and 18*g*, and RF front end chip 106*h* coupled to antennas 12*h*, 14*h*, 16*h*, and 18*h*. Antenna segment 115 also includes similar front end units having RF front end chip 106*i* coupled to antennas 12*i*, 14*i*, 16*i*, and 18*i*, RF front end chip 106*j* coupled to antennas 12*j*, 14*j*, 16*j*, and 18*j*, RF front end chip 106*k* coupled to antennas 12*k*, 14*k*, 16*k*, and 18*k*, and RF front end chip 106*l* coupled to antennas 12*l*, 14*l*, 16*l*, and 18*l*. Antenna segment 117 also includes similar front end units having RF front end chip 106*m* coupled to antennas 12*m*, 14*m*, 16*m*, and 18*m*, RF front end chip 106*n* coupled to antennas 12*n*, 14*n*, 16*n*, and 18*n*, RF front end chip 106*o* coupled to antennas 12*o*, 14*o*, 16*o*, and 18*o*, and RF front end chip 106*p* coupled to antennas 12*p*, 14*p*, 16*p*, and 18*p*.

As illustrated in FIG. 1B, master chip 108 is configured to drive in parallel control buses 110*a*, 110*b*, 110*c*, and 110*d* coupled to antenna segments 111, 113, 115, and 117, respectively. For example, control bus 110*a* is coupled to RF front end chips 106*a*, 106*b*, 106*c*, and 106*d* in antenna segment 111 to provide phase shift signals and amplitude control signals to the corresponding antennas coupled to each of RF front end chips 106*a*, 106*b*, 106*c*, and 106*d*. Control buses 110*b*, 110*c*, and 110*d* are configured to perform similar functions as control bus 110*a*. In the present implementation, master chip 180 and antenna segments 111, 113, 115, and 117 having RF front end chips 106*a* through 106*p* and antennas 12-18 are all integrated on a single printed circuit board.

It should be understood that layout diagram 190 in FIG. 1B is intended to show a simplified phased array antenna panel according to the present inventive concepts. In one implementation, master chip 180 may be configured to control a total of 2000 antennas disposed in ten antenna segments. In this implementation, master chip 180 may be configured to drive in parallel ten control buses, where each control bus is coupled to a respective antenna segment, where each antenna segment has a set of 50 RF front end chips and a group of 200 antennas are in each antenna segment; thus, each RF front end chip is coupled to four antennas. Even though this implementation describes each RF front end chip coupled to four antennas, this implementation is merely an example. An RF front end chip may be coupled to any number of antennas, particularly a number of antennas ranging from three to sixteen.

Figure 2:
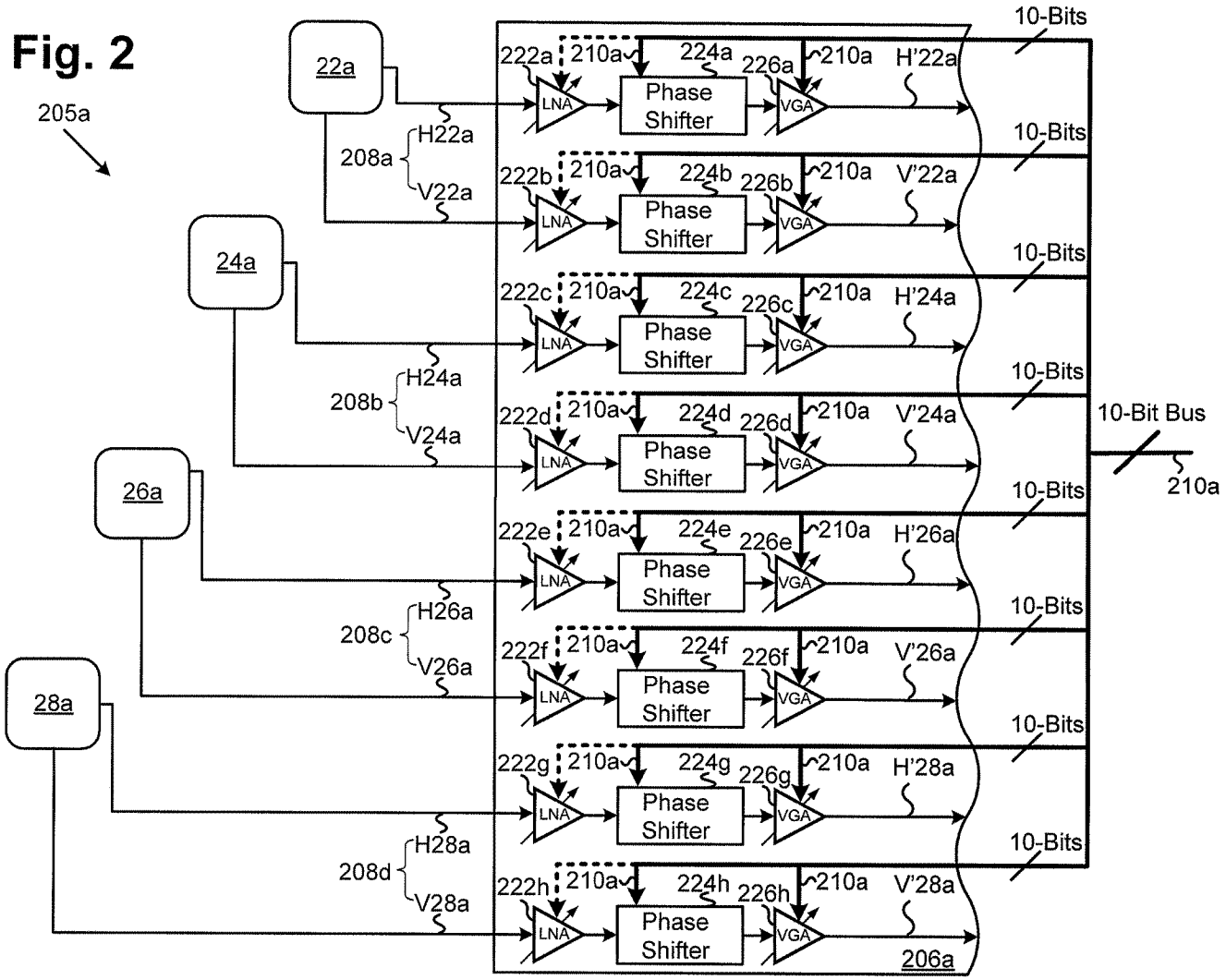
FIG. 2 illustrates a functional block diagram of a portion of an exemplary phased array antenna panel according to one implementation of the present application.

FIG. 2 illustrates a functional block diagram of a portion of an exemplary phased array antenna panel according to one implementation of the present application. In the present implementation, front end unit 205*a* may correspond to front end unit 105*a* in FIG. 1B of the present application. As illustrated in FIG. 2, front end unit 205*a* includes antennas 22*a*, 24*a*, 26*a*, and 28*a* coupled to RF front end chip 206*a*, where antennas 22*a*, 24*a*, 26*a*, and 28*a* and RF front end chip 206*a* may correspond to antennas 12*a*, 14*a*, 16*a*, and 18*a* and RF front end chip 106*a*, respectively, in FIG. 1B.

In the present implementation, antennas 22*a*, 24*a*, 26*a*, and 28*a* may be configured to receive signals from one or more commercial geostationary communication satellites, for example, which typically employ circularly polarized or linearly polarized signals defined at the satellite with a horizontally-polarized (H) signal having its electric-field oriented parallel with the equatorial plane and a vertically-polarized (V) signal having its electric-field oriented perpendicular to the equatorial plane. As illustrated in FIG. 2, each of antennas 22*a*, 24*a*, 26*a*, and 28*a* is configured to provide an H output and a V output to RF front end chip 206*a*.

For example, antenna 22*a* provides linearly polarized signal 208*a*, having horizontally-polarized signal H22*a* and vertically-polarized signal V22*a*, to RF front end chip 206*a*. Antenna 24*a* provides linearly polarized signal 208*b*, having horizontally-polarized signal H24*a* and vertically-polarized signal V24*a*, to RF front end chip 206*a*. Antenna 26*a* provides linearly polarized signal 208*c*, having horizontally-polarized signal H26*a* and vertically-polarized signal V26*a*, to RF front end chip 206*a*. Antenna 28*a* provides linearly polarized signal 208*d*, having horizontally-polarized signal H28*a* and vertically-polarized signal V28*a*, to RF front end chip 206*a*.

As illustrated in FIG. 2, horizontally-polarized signal H22*a* from antenna 22*a* is provided to a receiving circuit having low noise amplifier (LNA) 222*a*, phase shifter 224*a* and variable gain amplifier (VGA) 226*a*, where LNA 222*a* is configured to generate an output to phase shifter 224*a*, and phase shifter 224*a* is configured to generate an output to VGA 226*a*. In addition, vertically-polarized signal V22*a* from antenna 22*a* is provided to a receiving circuit including low noise amplifier (LNA) 222*b*, phase shifter 224*b* and variable gain amplifier (VGA) 226*b*, where LNA 222*b* is configured to generate an output to phase shifter 224*b*, and phase shifter 224*b* is configured to generate an output to VGA 226*b*.

As shown in FIG. 2, horizontally-polarized signal H24*a* from antenna 24*a* is provided to a receiving circuit having low noise amplifier (LNA) 222*c*, phase shifter 224*c* and variable gain amplifier (VGA) 226*c*, where LNA 222*c* is configured to generate an output to phase shifter 224*c*, and phase shifter 224*c* is configured to generate an output to VGA 226*c*. In addition, vertically-polarized signal V24*a* from antenna 24*a* is provided to a receiving circuit including low noise amplifier (LNA) 222*d*, phase shifter 224*d* and variable gain amplifier (VGA) 226*d*, where LNA 222*d* is configured to generate an output to phase shifter 224*d*, and phase shifter 224*d* is configured to generate an output to VGA 226*d*.

As illustrated in FIG. 2, horizontally-polarized signal H26*a* from antenna 26*a* is provided to a receiving circuit having low noise amplifier (LNA) 222*e*, phase shifter 224*e* and variable gain amplifier (VGA) 226*e*, where LNA 222*e* is configured to generate an output to phase shifter 224*e*, and phase shifter 224*e* is configured to generate an output to VGA 226*e*. In addition, vertically-polarized signal V26*a* from antenna 26*a* is provided to a receiving circuit including low noise amplifier (LNA) 222*f*, phase shifter 224*f* and variable gain amplifier (VGA) 226*f*, where LNA 222*f* is configured to generate an output to phase shifter 224*f*, and phase shifter 224*f* is configured to generate an output to VGA 226*f*.

As further shown in FIG. 2, horizontally-polarized signal H28*a* from antenna 28*a* is provided to a receiving circuit having low noise amplifier (LNA) 222*g*, phase shifter 224*g* and variable gain amplifier (VGA) 226*g*, where LNA 222*g* is configured to generate an output to phase shifter 224*g*, and phase shifter 224*g* is configured to generate an output to VGA 226*g*. In addition, vertically-polarized signal V28*a* from antenna 28*a* is provided to a receiving circuit including low noise amplifier (LNA) 222*h*, phase shifter 224*h* and variable gain amplifier (VGA) 226*h*, where LNA 222*h* is configured to generate an output to phase shifter 224*h*, and phase shifter 224*h* is configured to generate an output to VGA 226*h*.

As further illustrated in FIG. 2, control bus 210*a*, which may correspond to control bus 110*a* in FIG. 1B, is provided to RF front end chip 206*a*, where control bus 210*a* is configured to provide phase shift signals to phase shifters 224*a*, 224*b*, 224*c*, 224*d*, 224*e*, 224*f*, 224*g*, and 224*h* in RF front end chip 206*a* to cause a phase shift in at least one of these phase shifters, and to provide amplitude control signals to VGAs 226*a*, 226*b*, 226*c*, 226*d*, 226*e*, 226*f*, 226*g*, and 226*h*, and optionally to LNAs 222*a*, 222*b*, 222*c*, 222*d*, 222*e*, 222*f*, 222*g*, and 222*h* in RF front end chip 206*a* to cause an amplitude change in at least one of the linearly polarized signals received from antennas 22*a*, 24*a*, 26*a*, and 28*a*. It should be noted that control bus 210*a* is also provided to other front end units, such as front end units 105*b*, 105*c*, and 105*d* in segment 111 of FIG. 1B. In one implementation, at least one of the phase shift signals carried by control bus 210*a* is configured to cause a phase shift in at least one linearly polarized signal, e.g., horizontally-polarized signals H22*a* through H28*a* and vertically-polarized signals V22*a* through V28*a*, received from a corresponding antenna, e.g., antennas 22*a*, 24*a*, 26*a*, and 28*a*.

In one implementation, amplified and phase shifted horizontally-polarized signals H'22*a*, H'24*a*, H'26*a*, and H'28*a* in front end unit 205*a*, and other amplified and phase shifted horizontally-polarized signals from the other front end units, e.g. front end units 105*b*, 105*c*, and 105*d* as well as front end units in antenna segments 113, 115, and 117 shown in FIG. 1B, may be provided to a summation block (not explicitly shown in FIG. 2), that is configured to sum all of the powers of the amplified and phase shifted horizontally-polarized signals, and combine all of the phases of the amplified and phase shifted horizontally-polarized signals, to provide an H-combined output to a master chip such as master chip 180 in FIG. 1. Similarly, amplified and phase shifted vertically-polarized signals V'22*a*, V'24*a*, V'26*a*, and V'28*a* in front end unit 205*a*, and other amplified and phase shifted vertically-polarized signals from the other front end units, e.g. front end units 105*b*, 105*c*, and 105*d* as well as front end units in antenna segments 113, 115, and 117 shown in FIG. 1B, may be provided to a summation block (not explicitly shown in FIG. 2), that is configured to sum all of the powers of the amplified and phase shifted horizontally-polarized signals, and combine all of the phases of the amplified and phase shifted horizontally-polarized signals, to provide a V-combined output to a master chip such as master chip 180 in FIG. 1.

Figure 3:
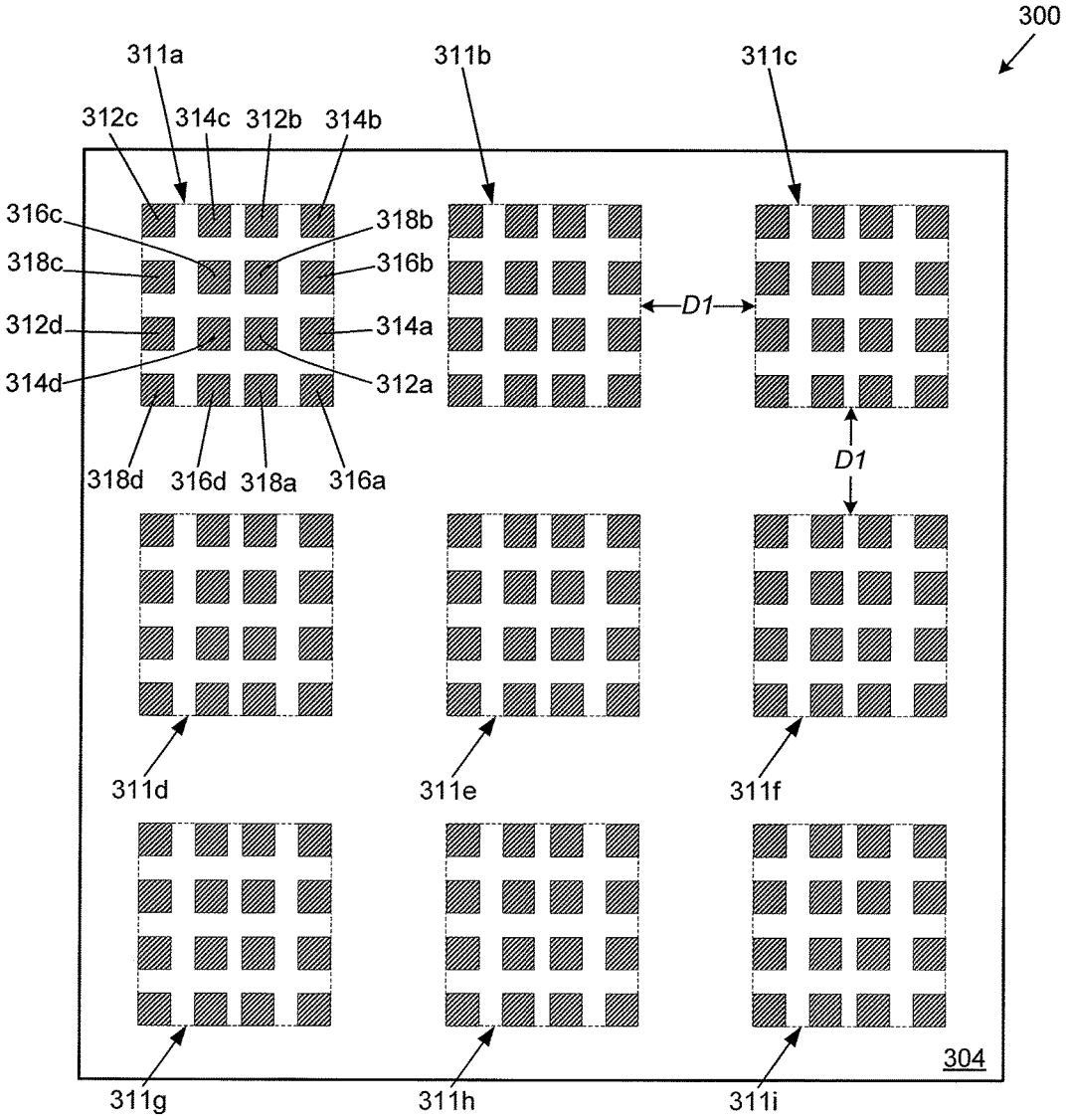
FIG. 3 illustrates a top view of an exemplary phased array antenna panel according to one implementation of the present application.

FIG. 3 illustrates a top view of an exemplary phased array antenna panel according to one implementation of the present application. As illustrated in FIG. 3, exemplary phased array antenna panel 300 includes front surface 304, antennas 312*a*, 312*b*, 312*c*, 312*d*, 314*a*, 314*b*, 314*c*, 314*d*, 316*a*, 316*b*, 316*c*, 316*d*, 318*a*, 318*b*, 318*c*, and 318*d*, collectively referred to as antennas 312-318, and antenna segments 311*a*, 311*b*, 311*c*, 311*d*, 311*e*, 311*f*, 311*g*, 311*h*, and 311*i*, collectively referred to as antenna segments 311. As shown in FIG. 3, each one of antenna segments 311 in phased array antenna panel 300 comprises a number of antennas similar to antennas 312-318 in antenna segment 311*a*. Some features discussed in conjunction with the layout diagram of FIG. 1B, such as a master chip, control and data buses, and RF front end chips, are omitted in FIG. 3 for the purposes of clarity.

As illustrated in FIG. 3, antennas 312-318 may be arranged on front surface 304 in antenna various antenna segments 311. In one implementation, the distance between one antenna and an adjacent antenna in each one of antenna segments 311 is a fixed distance, such as a quarter wavelength (i.e., λ/4). For example, the distance between antenna 312*c* and adjacent antenna 314*c* in antenna segment 311*a* may be a quarter wavelength (i.e., λ/4). In one implementation, antenna segments 311 may be square-formatted. Square-formatted antenna segments 311 may have sides with equal lengths. The number of antennas 312-318 arranged along one side of square-formatted antenna segments 311 may be equal to the number of antennas 312-318 arranged along another side. As illustrated in FIG. 3, each one of square-formatted antenna segments 311 encloses sixteen antennas 312-318, four antennas on each side. In other implementations, square-formatted antenna segments 311 may have two antennas on each side, eight antennas on each side, or any other number of antennas on each side as desired in a particular design.

As shown in FIG. 3, multiple antenna segments 311 may be arranged on front surface 304 of phased array antenna panel 300. In one implementation, the distance between adjacent antenna segments 311 is a fixed distance. As one example shown in FIG. 3, a fixed distance D1 separates antenna segment 311*c* from adjacent antenna segments 311*b* and 311*f*, with no antenna therebetween. In one implementation, distance D1 may be greater than a quarter wavelength (i.e., greater than λ/4).

Figure 4A:
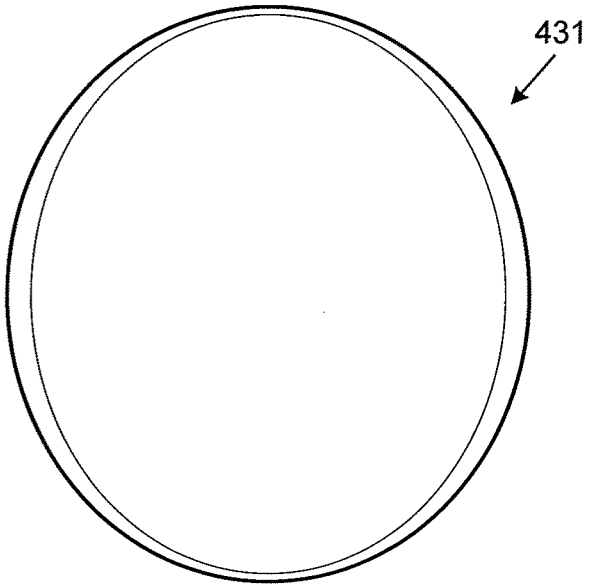
FIG. 4A illustrates a top view of an exemplary lens according to one implementation of the present application.

FIG. 4A illustrates a top view of an exemplary lens according to one implementation of the present application. As illustrated in FIG. 4A, lens 431 is circle-shaped. Circle-shaped lens 431 may be combined with a phased array antenna panel, as will be described further below. Circle-shaped lens 431 may be a dielectric lens, e.g., made of polystyrene or Lucite® and polyethylene. In other implementations, circle-shaped lens 431 may be a Fresnel zone plate lens, or a metallic waveguide lens.

Figure 4B:
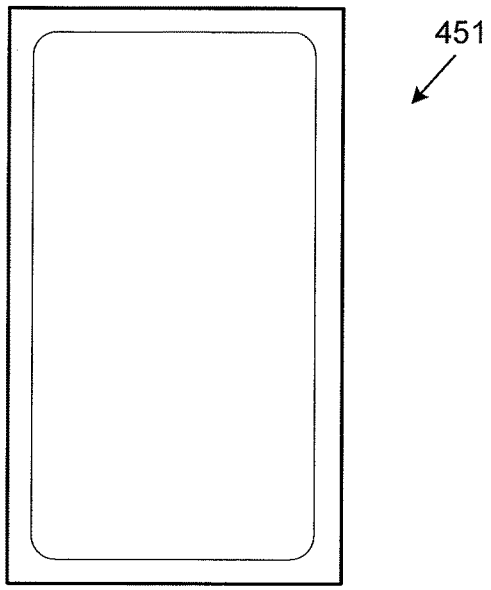
FIG. 4B illustrates a top view of an exemplary lens according to one implementation of the present application.

FIG. 4B illustrates a top view of an exemplary lens according to one implementation of the present application. As illustrated in FIG. 4B, lens 451 is rectangle-shaped. Rectangle-shaped lens 451 may be combined with a phased array antenna panel, as will be described further below. Rectangle-shaped lens 451 may be a dielectric lens, e.g., made of polystyrene or Lucite® and polyethylene. In other implementations, circle-shaped lens 451 may be a Fresnel zone plate lens, or a metallic waveguide lens.

Figure 5:
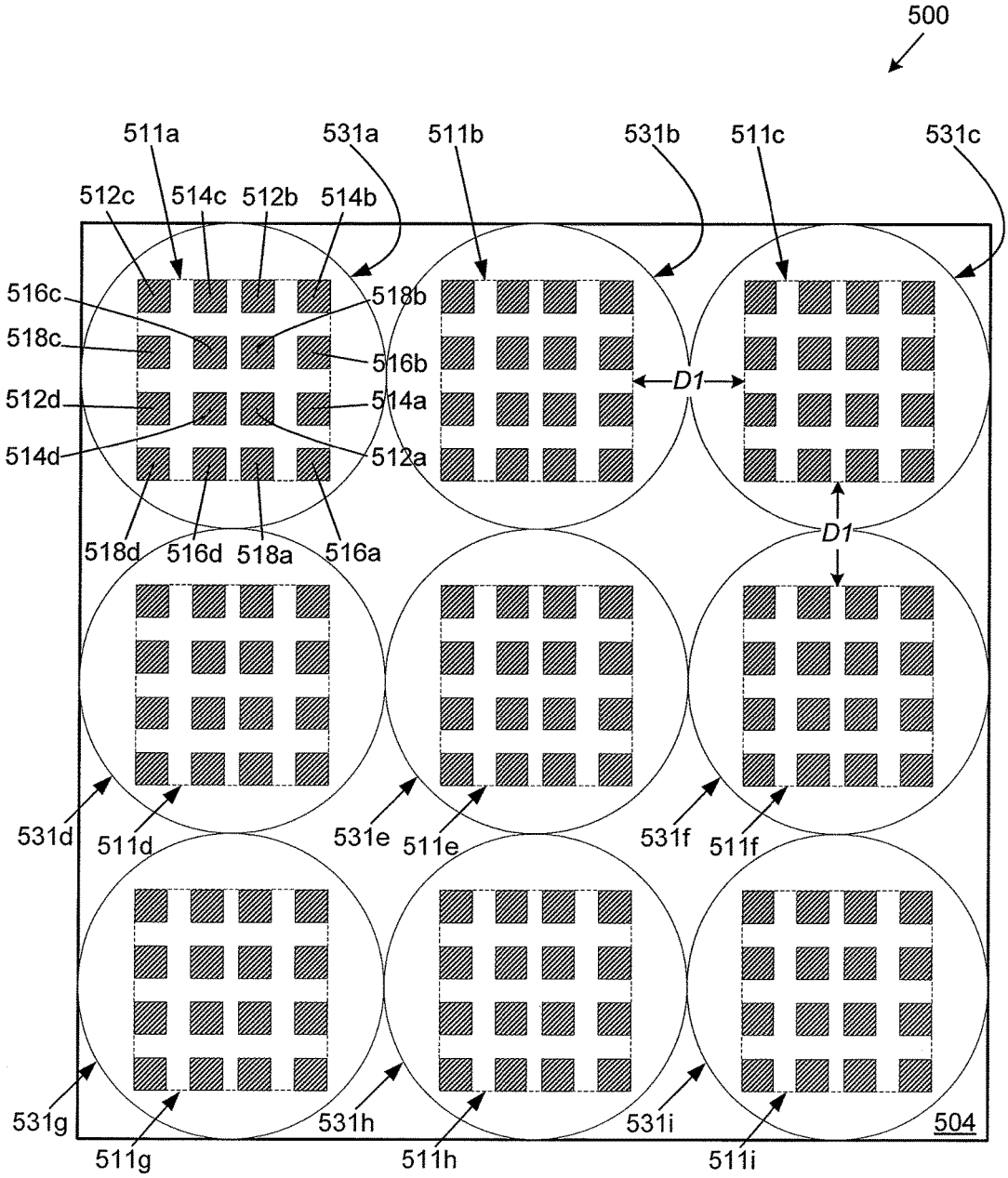
FIG. 5 illustrates a top view of an exemplary lens-enhanced phased array antenna panel according to one implementation of the present application.

FIG. 5 illustrates a top view of an exemplary lens-enhanced phased array antenna panel according to one implementation of the present application. As illustrated in FIG. 5, exemplary lens-enhanced phased array antenna panel 500 includes front surface 504, antennas 512*a*, 512*b*, 512*c*, 512*d*, 514*a*, 514*b*, 514*c*, 514*d*, 516*a*, 516*b*, 516*c*, 516*d*, 518*a*, 518*b*, 518*c*, and 518*d*, collectively referred to as antennas 512-518, antenna segments 511*a*, 511*b*, 511*c*, 511*d*, 511*e*, 511*f*, 511*g*, 511*h*, and 511*i*, collectively referred to as antenna segments 511, and lenses 531*a*, 531*b*, 531*c*, 531*d*, 531*e*, 531*f*, 531*g*, 531*h*, and 531*i*, collectively referred to as lenses 531. Phased array antenna panel 500, antennas 512-518, and antenna segments 511 may have any of the configurations described above with reference to FIG. 3.

As illustrated in FIG. 5, lenses 531 are situated over phased array antenna panel 500. In FIG. 5, phased array antenna panel 500 is seen through lenses 531. As further shown in FIG. 5, lenses 531 are circle-shaped. Circle-shaped lenses 531 in FIG. 5 may have a configuration similar to circle-shaped lens 431 in FIG. 4A. Circle-shaped lenses 531 may be dielectric lenses, e.g., made of polystyrene or Lucite® and polyethylene. In other implementations, circle-shaped lenses 531 may be Fresnel zone plate lenses, or metallic waveguide lenses. Lenses 531 may be separate lenses, each individually placed over phased array antenna panel 500. Alternatively, lenses 531 may be placed over phased array antenna panel 500 as a lens array, where one substrate holds together multiple lenses 531.

Lenses 531 may have corresponding antenna segments 511 of the phased array antenna panel 500. For example, as illustrated in FIG. 5, circle-shaped lens 531*b* may correspond to square-formatted antenna segment 511*b*. It should be understood that, in other implementations of the present application, one lens may correspond to more than one antenna segment, and not all antenna segments must have a corresponding lens. Lenses 531 may increase gains of their corresponding antenna segments 511 in phased array antenna panel 500 by focusing an incoming RF beam onto their corresponding antenna segments 511. Master chip 180 (not shown in FIG. 5) may be configured to control the operation of antenna segments 511, and to receive a combined output, as stated above with reference to FIGS. 1B and 2. Thus, by increasing the gain of each one of, or selected ones of, antenna segments 511, the total gain of the phased array antenna panel 500 is increased, resulting in an increase in the power of RF signals being processed by phased array antenna panel 500, without increasing the area of the phased array antenna panel or the number of antennas therein.

Figure 6:
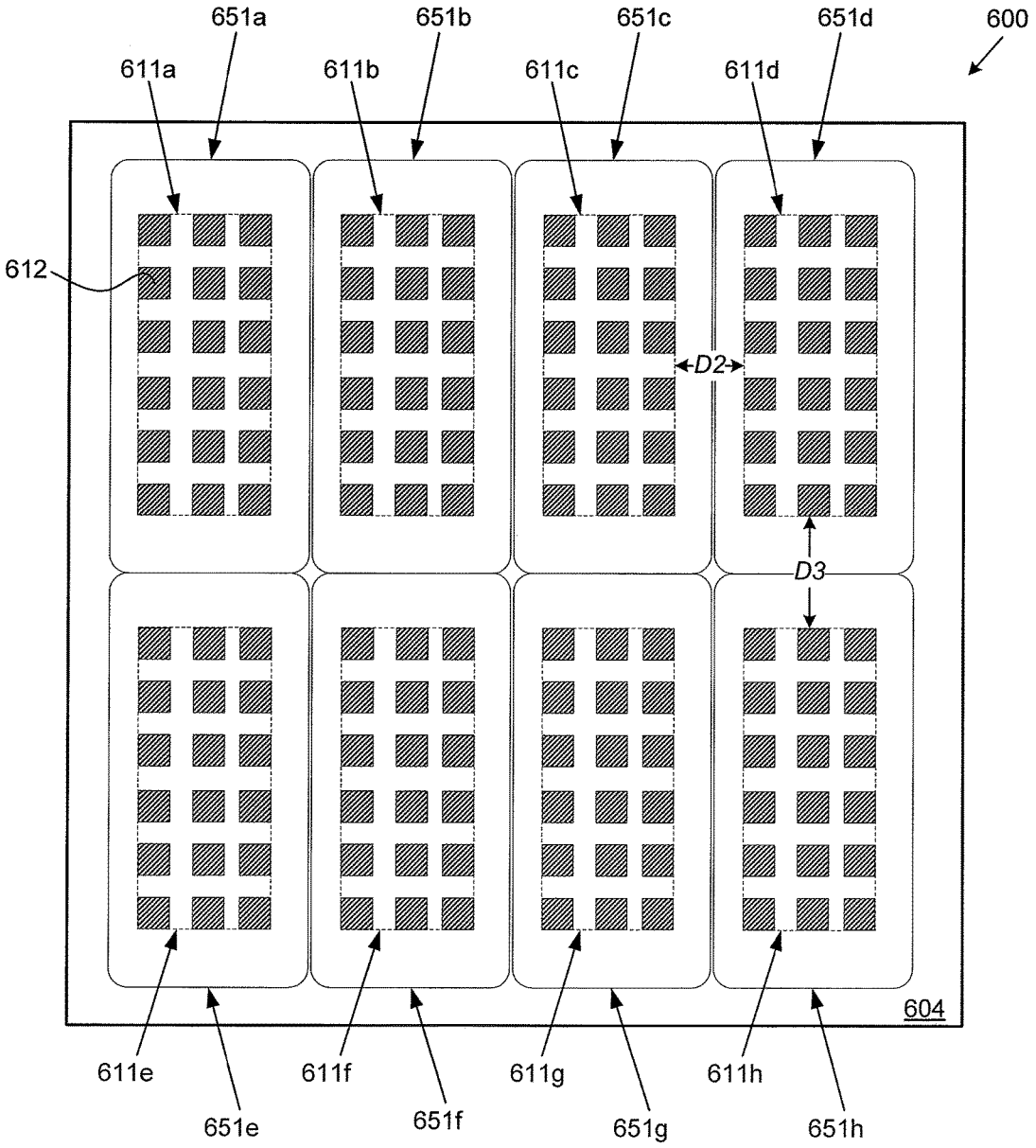
FIG. 6 illustrates a top view of an exemplary lens-enhanced phased array antenna panel according to one implementation of the present application.

FIG. 6 illustrates a top view of an exemplary lens-enhanced phased array antenna panel according to one implementation of the present application. FIG. 6 shows exemplary phased array antenna panel 600 that includes antennas 612, antenna segments 611*a*, 611*b*, 611*c*, 611*d*, 611*e*, 611*f*, 611*g*, and 611*h*, collectively referred to as antenna segments 611, and lenses 651*a*, 651*b*, 651*c*, 561*d*, 651*e*, 651*f*, 651*g*, and 651*h*, collectively referred to as lenses 651. Some features discussed in conjunction with the layout diagram of FIG. 1B, such as a master chip, control and data buses, and RF front end chips, are omitted in FIG. 6 for the purposes of clarity.

As illustrated in FIG. 6, antennas 612 may be arranged on front surface 604 in antenna segments 611. In one implementation, the distance between one antenna 612 and an adjacent antenna 612 within each one of antenna segments 611 is a fixed distance that does not vary between the different antennas in the same antenna segment. For example, the distance may be a quarter wavelength (i.e., λ/4). In one implementation, antenna segments 611 may be rectangle-formatted. Rectangle-formatted antenna segments 611 may have sides with different lengths. The number of antennas 612 arranged along one side of rectangle-formatted antenna segments 611 may be greater or less than the number of antennas 612 arranged along another side.

As illustrated in FIG. 6, rectangle-formatted antenna segments 611 comprise eighteen antennas 612, six on one side and three on another side. In other implementations, rectangle-formatted antenna segments 611 may have five antennas on one side and two antennas on another side, or eight antennas on one side and four antennas on another side, or any other number of antennas on each side. Multiple antenna segments 611 may be arranged on front surface 604 of phased array antenna panel 600. In one implementation, the adjacent antenna segments 611 are separated by fixed distances. As illustrated in FIG. 6, a fixed distance D2 separates antenna segment 611*c* and adjacent antenna segment 611*d*, with no antenna therebetween, and a fixed distance D3 separates antenna segment 611*d* and adjacent antenna segment 611*h*, with no antenna therebetween. In one implementation, distances D2 and D3 may be greater than a quarter wavelength (i.e., greater than λ/4). Distances D2 and D3 may be equal or may be different from one another.

As illustrated in FIG. 6, lenses 651 are situated over phased array antenna panel 600. In FIG. 6, phased array antenna panel 600 is seen through lenses 651. As further illustrated in FIG. 6, lenses 651 may be rectangle-shaped. Rectangle-shaped lenses 651 in FIG. 6 may have a configuration similar to rectangle-shaped lens 451 in FIG. 4B. Rectangle-shaped lenses 651 may be dielectric lenses, e.g., made of polystyrene or Lucite® and polyethylene. In other implementations, rectangle-shaped lenses 651 may be Fresnel zone plate lenses, or metallic waveguide lenses. Lenses 651 may be separate lenses, each individually placed over phased array antenna panel 600. Alternatively, lenses 651 may be placed over phased array antenna panel 600 as a lens array, where one substrate holds together multiple lenses 651.

Lenses 651 may have corresponding antenna segments 611 of the phased array antenna panel 600. For example, as illustrated in FIG. 6, rectangle-shaped lens 651*a* may correspond to rectangle-formatted antenna segment 611*a*. It should be understood that, in other implementations of the present application, one lens may correspond to more than one antenna segment, and not all antenna segments must have a corresponding lens.

Lenses 651 may increase gains of their corresponding antenna segments 611 in phased array antenna panel 600 by focusing an incoming RF beam onto their corresponding antenna segments 611. Master chip 180 (not shown in FIG. 6) may be configured to control the operation of antenna segments 611, and to receive a combined output, as stated above with reference to FIGS. 1B and 2. Thus, by increasing the gain of each one of, or selected ones of, antenna segments 611, the total gain of the phased array antenna panel 600 is increased, resulting in an increase in the power of RF signals being processed by phased array antenna panel 600, without increasing the area of the phased array antenna panel or the number of antennas therein.

Figure 7:
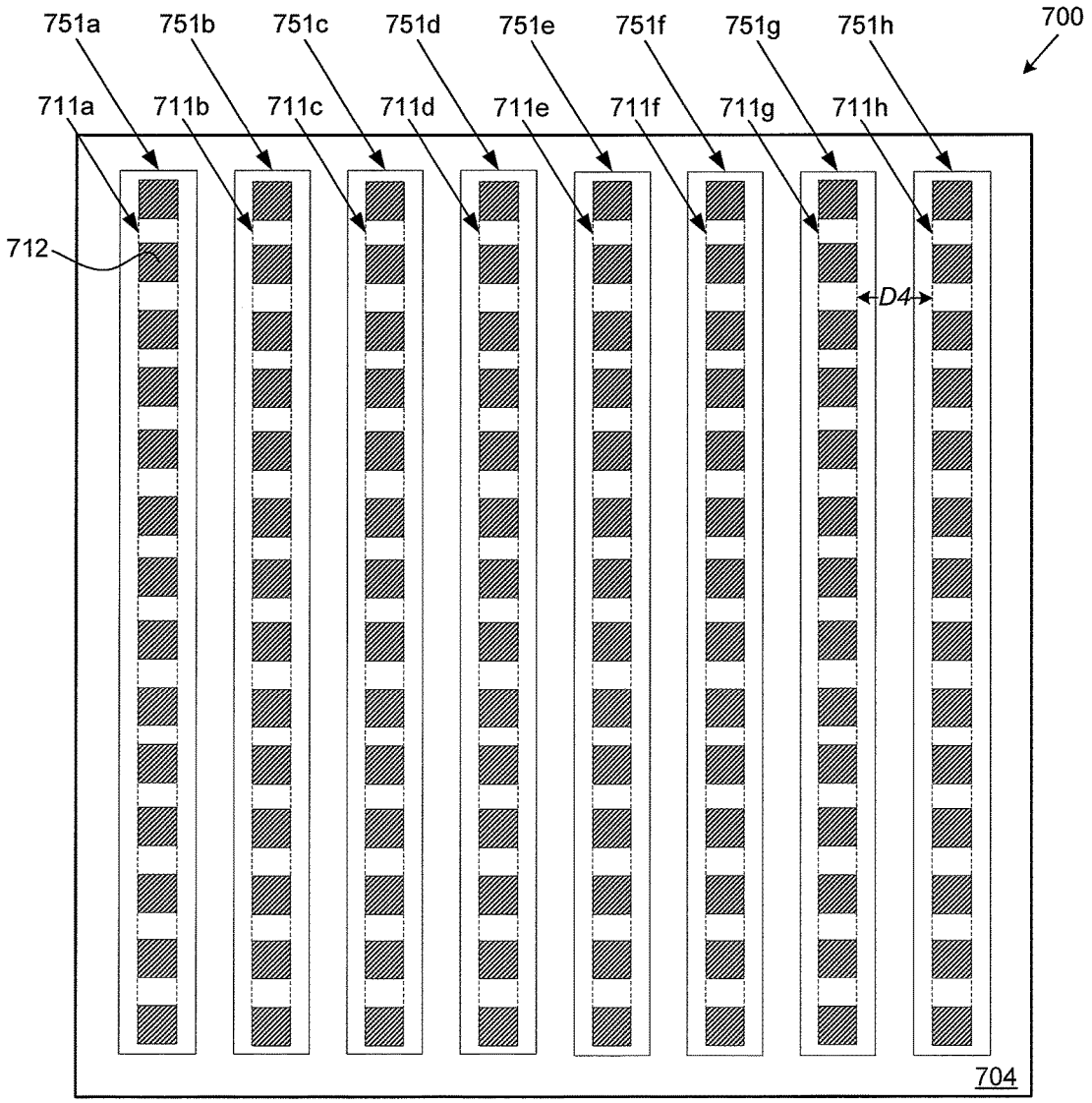
FIG. 7 illustrates a top view of an exemplary lens-enhanced phased array antenna panel according to one implementation of the present application.

FIG. 7 illustrates a top view of an exemplary lens-enhanced phased array antenna panel according to one implementation of the present application. As illustrated in FIG. 7, exemplary phased array antenna panel 700 includes antennas 712, antenna segments 711*a*, 711*b*, 711*c*, 711*d*, 711*e*, 711*f*, 711*g*, and 711*h*, collectively referred to as antenna segments 711, and lenses 751*a*, 751*b*, 751*c*, 761*d*, 751*e*, 751*f*, 751*g*, and 751*h*, collectively referred to as lenses 751. Some features discussed in conjunction with the layout diagram of FIG. 1B, such as a master chip, control and data buses, and RF front end chips, are omitted in FIG. 7 for the purposes of clarity.

As illustrated in FIG. 7, antennas 712 may be arranged on front surface 704 in antenna segments 711. In one implementation, the distance between one antenna 712 and an adjacent antenna 712 within each one of antenna segments 711 is a fixed distance that does not vary between the different antennas in the same antenna segment. For example, the distance may be a quarter wavelength (i.e., λ/4). In one implementation, antenna segments 711 may be row-formatted. Row-formatted antenna segments 711 may have sides with different lengths. One antenna 712 may be arranged along one side of row-formatted antenna segments 711, and a number of antennas 712 may be arranged along another side to form a row of antennas. As illustrated in FIG. 7, row-formatted antenna segments 711 comprise a row of fourteen antennas 712. In other implementations, row-formatted antenna segments 711 may be a row of four antennas, a row of twelve antennas, or any other number of antennas. Multiple antenna segments 711 may be arranged on front surface 704 of phased array antenna panel 700. In one implementation, the distance between adjacent antenna segments 711 is a fixed distance. As one example shown in FIG. 7, a fixed distance D4 separates antenna segment 711*g* and adjacent antenna segment 711*h*, with no antenna therebetween. In one implementation, distance D4 may be greater than a quarter wavelength (i.e., greater than λ/4).

As illustrated in FIG. 7, lenses 751 are situated over phased array antenna panel 700. In FIG. 7, phased array antenna panel 700 is seen through lenses 751. As further illustrated in FIG. 7, lenses 751 in FIG. 7 may have a configuration similar to rectangle-shaped lens 451 in FIG. 4B, except that row-shaped lenses 751 are narrower, elongated, and used with row-formatted antenna segments 711. Thus, lenses 751 are referred to as row-shaped lenses in the present application. Row-shaped lenses 751 may be dielectric lenses, e.g., made of polystyrene or Lucite® and polyethylene. In other implementations, row-shaped lenses 751 may be Fresnel zone plate lenses, or a metallic waveguide lenses. Lenses 751 may be separate lenses, each individually placed over phased array antenna panel 700. Alternatively, lenses 751 may be placed over phased array antenna panel 700 as a lens array, where one substrate holds together multiple lenses 751.

Lenses 751 may have corresponding antenna segments 711 of the phased array antenna panel 700. For example, as illustrated in FIG. 7, row-shaped lens 751*a* may correspond to row-formatted antenna segment 711*a*. It should be understood that, in other implementations of the present application, one lens may correspond to more than one antenna segment, and not all antenna segments must have a corresponding lens.

Lenses 751 may increase gains of their corresponding antenna segments 711 in phased array antenna panel 700 by focusing an incoming RF beam onto their corresponding antenna segments 711. Master chip 180 (not shown in FIG. 7) may be configured to control the operation of antenna segments 711, and to receive a combined output, as stated above with reference to FIGS. 1B and 2. Thus, by increasing the gain of each one of, or selected ones of, antenna segments 711, the total gain of the phased array antenna panel 700 is increased, resulting in an increase in the power of RF signals being processed by the phased array antenna panel 700, without increasing the area of the phased array antenna panel or the number of antennas therein.

Figure 8A:
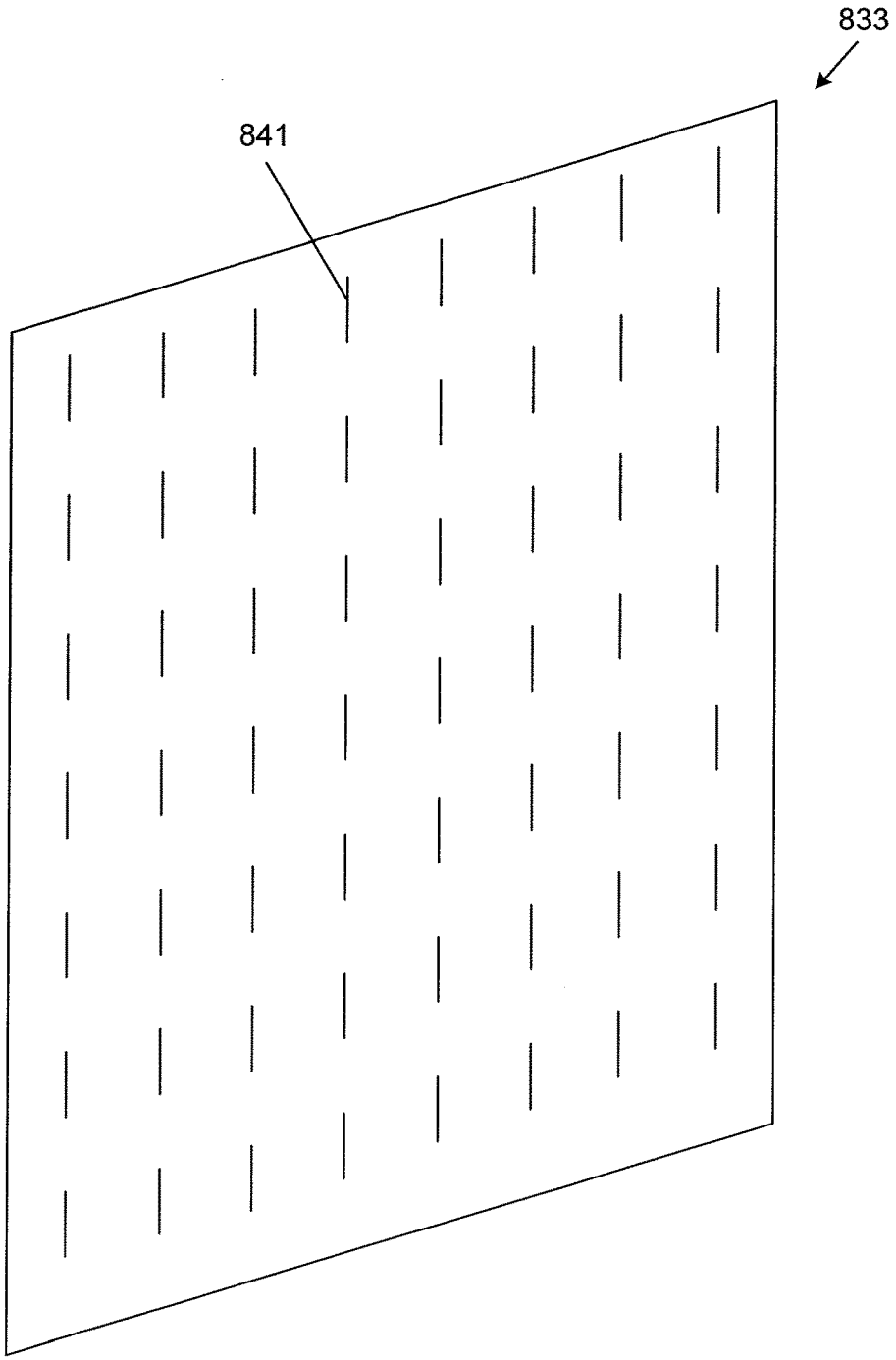
FIG. 8A illustrates a perspective view of an exemplary lens according to one implementation of the present application.

FIG. 8A illustrates a perspective view of an exemplary lens according to one implementation of the present application. As illustrated in FIG. 8A, lens 833 includes perforations 841. In one implementation, perforations 841 may be an array of slots. The dimension and position of each slot may be configured so that lens 833 can focus an incoming RF beam in a desired angle and to a desired direction. In other words, the dimensions and spacing of each slot may be configured so that lens 833 may have an angular offset, as will be described further below. As further illustrated in FIG. 8A, lens 833 may be a flat (or substantially flat) lens, as opposed to a conventional dielectric convex or concave lens. When employing a lens, such as lens 833 in FIG. 8A, that causes an angular offset to direct the incoming RF beams onto an underlying antenna segment, the total gain of the phased array antenna panel is increased due to the enhanced gain of the antenna segment underlying the lens as well as the effect caused by the angular offset in directing the RF beams onto the corresponding antenna segment.

Figure 8B:
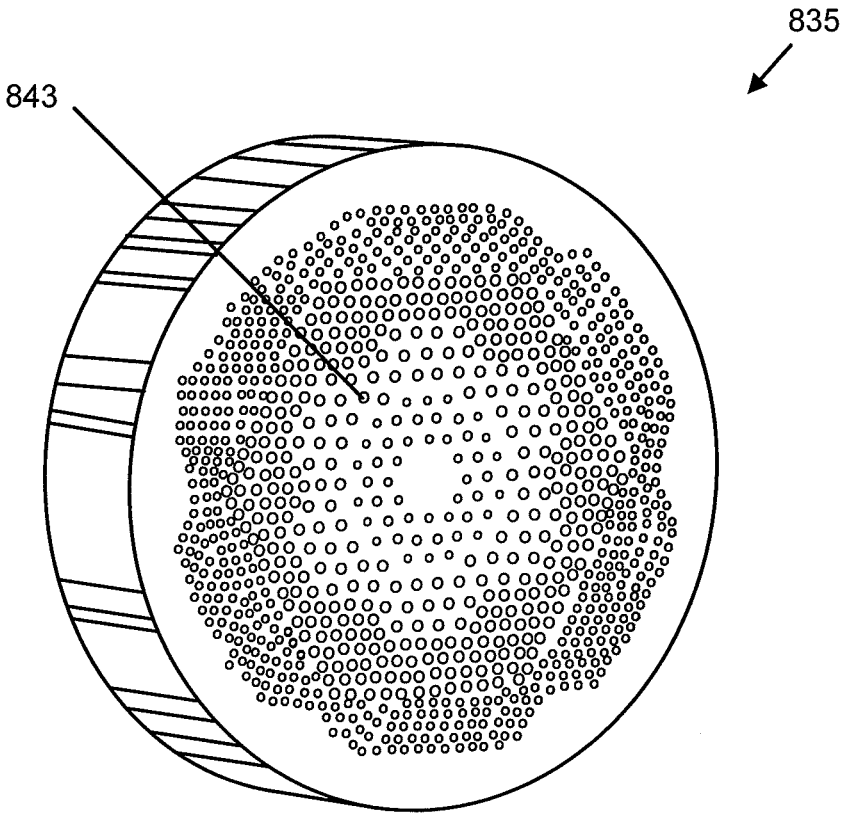
FIG. 8B illustrates a perspective view of an exemplary lens according to one implementation of the present application.

FIG. 8B illustrates a perspective view of an exemplary lens according to one implementation of the present application. As illustrated in FIG. 8B, lens 835 includes perforations 843. In one implementation, lens 835 may be a homogenous dielectric substrate and perforations 843 may be holes. The diameter and position of each hole may be varied in order to vary the relative permittivity of lens 835, thereby creating a delay profile. For example, lens 835 may be a circle-shaped lens having a relative permittivity that decreases continuously and radially. The delay profile may be configured so that lens 835 can focus an incoming RF beam in a desired angle and to a desired direction. In other words, the delay profile may be configured so that lens 835 may have an angular offset, as will be described further below. As further illustrated in FIG. 8B, lens 835 may be a flat (or substantially flat) lens, as opposed to a conventional dielectric convex or concave lens. When employing a lens, such as lens 835 in FIG. 8B, that causes an angular offset to direct the incoming RF beams onto an underlying antenna segment, the total gain of the phased array antenna panel is increased due to the enhanced gain of the antenna segment underlying the lens as well as the effect caused by the angular offset in directing the RF beams onto the corresponding antenna segment.

Figure 9A:
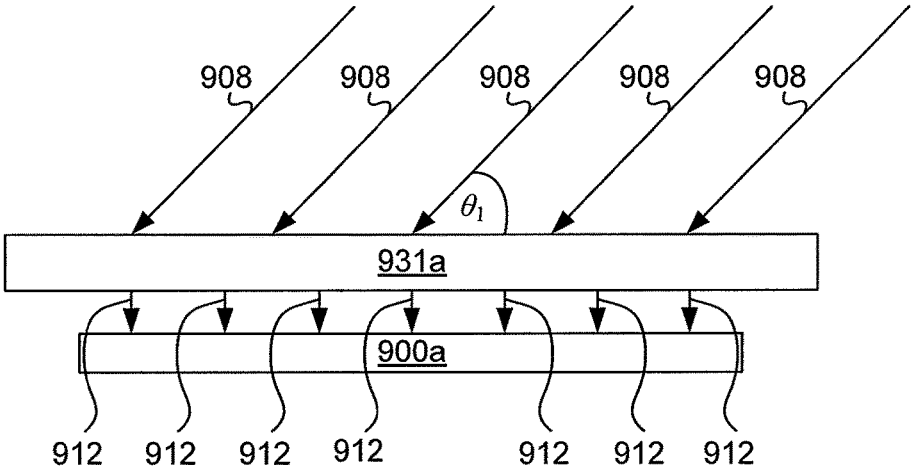
FIG. 9A illustrates a side view of an exemplary lens-enhanced phased array antenna panel according to one implementation of the present application.

FIG. 9A illustrates a side view of an exemplary lens-enhanced phased array antenna panel according to one implementation of the present application. As illustrated in FIG. 9A, lens-enhanced phased array antenna panel includes lens 931*a* situated over phased array antenna panel 900*a*. Lens 931*a* and phased array antenna panel 900*a* may have any of the configurations described above further. As further illustrated in FIG. 9A, lens 931*a* may have angular offset $\theta_1$. RF beams, such as RF beams 908, incoming at angular offset $\theta_1$ will be directed by lens 931*a* onto phased array antenna panel, as indicated by the direction of arrows 912 in FIG. 9A. When employing a lens, such as lens 931*a* in FIG. 9A, that causes an angular offset to direct the incoming RF beams onto an underlying antenna segment, the total gain of the phased array antenna panel is increased due to the enhanced gain of the antenna segment underlying the lens as well as the effect caused by the angular offset in directing the RF beams onto the corresponding antenna segment.

Figure 9B:
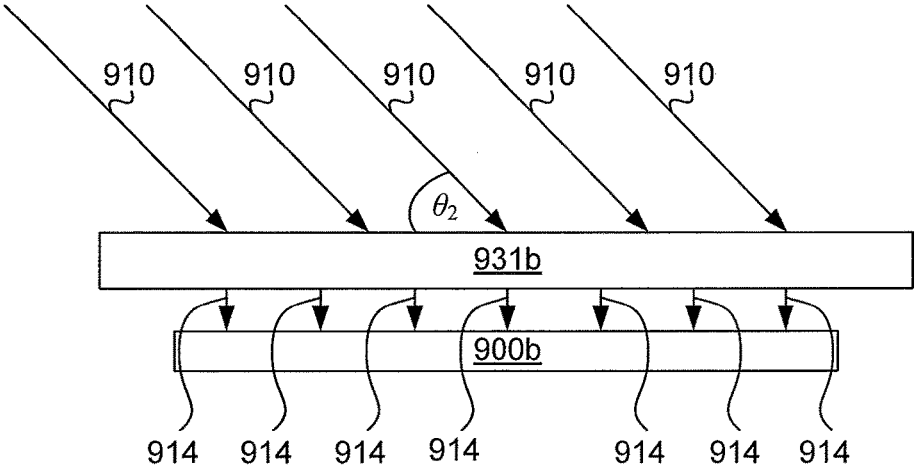
FIG. 9B illustrates a side view of an exemplary lens-enhanced phased array antenna panel according to one implementation of the present application.

FIG. 9B illustrates a side view of an exemplary lens-enhanced phased array antenna panel according to one implementation of the present application. As illustrated in FIG. 9B, lens-enhanced phased array antenna panel includes lens 931*b* situated over phased array antenna panel 900*b*. Lens 931*b* and phased array antenna panel 900*b* in FIG. 9B may be similar to lens 931*a* and phased array antenna panel 900*a* in FIG. 9A, but lens 931*b* may have a different angular offset $\theta_2$. RF beams, such as RF beams 910, incoming at angular offset $\theta_2$ will be directed by lens 931*b* onto phased array antenna panel, as indicated by the direction of arrows 914 in FIG. 9B. When employing a lens, such as lens 931*b* in FIG. 9B, that causes an angular offset to direct the incoming RF beams onto an underlying antenna segment, the total gain of the phased array antenna panel is increased due to the enhanced gain of the antenna segment underlying the lens as well as the effect caused by the angular offset in directing the RF beams onto the corresponding antenna segment.

Thus, various implementations of the present application result in an increased power received by a wireless receiver employing a phased array antenna panel without increasing the size of the phased array antennal panel.

From the above description it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

The invention claimed is:

1. A lens-enhanced phased array antenna panel comprising:

a plurality of antennas arranged in a plurality of antenna segments on a front surface of said phased array antenna panel;

a plurality of lenses situated over said front surface of said phased array antenna panel;

each of said plurality of lenses situated over a corresponding antenna segment in said plurality of antenna segments;

each of said plurality of lenses increasing a gain of said corresponding antenna segment in said plurality of antenna segments so as to increase a total gain of said phased array antenna panel.

2. The lens-enhanced phased array antenna panel of claim 1, wherein said antenna segments are square-formatted antenna segments and said plurality of lenses are circle-shaped.

3. The lens-enhanced phased array antenna panel of claim 1, wherein said antenna segments are rectangle-formatted antenna segments and said plurality of lenses are rectangle-shaped.

4. The lens-enhanced phased array antenna panel of claim 1, wherein said antenna segments are row-formatted antenna segments and said plurality of lenses are row-shaped.

5. The lens-enhanced phased array antenna panel of claim 1 further comprising:

a plurality of radio frequency (RF) front end chips;

a master chip;

wherein said master chip provides phase shift signals for said plurality of antennas through said plurality of RF front end chips.

6. The lens-enhanced phased array antenna panel of claim 5, wherein said plurality of antennas and said master chip are integrated in a single printed circuit board (PCB).

7. The lens-enhanced phased array antenna panel of claim 1 further comprising:

a plurality of radio frequency (RF) front end chips;

a master chip;

wherein said master chip provides amplitude control signals for said plurality of antennas through said plurality of RF front end chips.

8. The lens-enhanced phased array antenna panel of claim 1, wherein at least one of said plurality of lenses is substantially flat.

9. The lens-enhanced phased array antenna panel of claim 1, wherein at least one of said plurality of lenses comprises a plurality of perforations.

10. The lens-enhanced phased array antenna panel of claim 9, wherein said plurality of perforations provide an angular offset to direct a radio frequency (RF) beam onto said corresponding antenna segment.

11. A lens-enhanced phased array antenna panel comprising:

a plurality of antennas arranged in a plurality of antenna segments on a front surface of said phased array antenna panel;

a plurality of lenses situated over said front surface of said phased array antenna panel;

each of said plurality of lenses situated over a corresponding antenna segment in said plurality of antenna segments;

each of said plurality of lenses increasing a gain of said corresponding antenna segment in said plurality of antenna segments;

each of said plurality of lenses providing an angular offset to direct a radio frequency (RF) beam onto said least one corresponding antenna segment;

said gain and said angular offset causing an increase in a total gain of said phased array antenna panel.

12. The lens-enhanced phased array antenna panel of claim 11, wherein said antenna segments are square-formatted antenna segments and said plurality of lenses are circle-shaped.

13. The lens-enhanced phased array antenna panel of claim 11, wherein said antenna segments are rectangle-formatted antenna segments and said plurality of lenses are rectangle-shaped.

14. The lens-enhanced phased array antenna panel of claim 11, wherein said antenna segments are row-formatted antenna segments and said plurality of lenses are row-shaped.

15. The lens-enhanced phased array antenna panel of claim 11 further comprising:

a plurality of radio frequency (RF) front end chips;

a master chip;

wherein said master chip provides phase shift signals for said plurality of antennas through said plurality of RF front end chips.

16. The lens-enhanced phased array antenna panel of claim 15, wherein said plurality of antennas and said master chip are integrated in a single printed circuit board (PCB).

17. The lens-enhanced phased array antenna panel of claim 11 further comprising:

a plurality of radio frequency (RF) front end chips;

a master chip;

wherein said master chip provides amplitude control signals for said plurality of antennas through said plurality of RF front end chips.

18. The lens-enhanced phased array antenna panel of claim 11, wherein at least one of said plurality of lenses is substantially flat.

19. The lens-enhanced phased array antenna panel of claim 11, wherein at least one of said plurality of lenses comprises a plurality of perforations.

20. The lens-enhanced phased array antenna panel of claim 19, wherein said plurality of perforations provide said angular offset.

* * * * *